United States Patent [19]

Eerola

[11] Patent Number: 4,637,599

[45] Date of Patent: Jan. 20, 1987

[54] SUCTION-LIFTING CONVEYOR FOR TRANSFER FOR SHEET-SHAPED OBJECTS

[75] Inventor: Matti V. Eerola, Sairakkala, Finland

[73] Assignee: Raute Oy, Lahti, Finland

[21] Appl. No.: 783,955

[22] Filed: Oct. 3, 1985

[30] Foreign Application Priority Data

Oct. 12, 1984 [FI] Finland ..... 844029

[51] Int. Cl.[4] ..... B65H 3/12; B65H 3/44; B65H 5/22

[52] U.S. Cl. ..... 271/5; 271/9; 271/12; 271/197; 271/276

[58] Field of Search ..... 271/5, 9, 6, 11–13, 271/90, 93, 94, 197, 276; 414/121

[56] References Cited

U.S. PATENT DOCUMENTS

| | | | |
|---|---|---|---|
| 2,753,795 | 7/1956 | Bruns | 271/12 |
| 3,409,149 | 11/1968 | Graux | 271/11 |
| 3,463,483 | 8/1969 | Keller et al. | 271/11 |
| 4,382,593 | 5/1983 | Beran et al. | 271/12 |

FOREIGN PATENT DOCUMENTS

| | | | |
|---|---|---|---|
| 0007568 | 1/1977 | Japan | 271/11 |
| 1429483 | 3/1976 | United Kingdom | 271/12 |

*Primary Examiner*—Duane A. Reger
*Assistant Examiner*—James E. Barlow
*Attorney, Agent, or Firm*—Wolf, Greenfield & Sacks

[57] ABSTRACT

The invention is concerned with a suction-lifting conveyor for the transfer of sheet-shaped objects, in particular of sheets of plywood veneer (4), one by one from a stack to further processing or to another stack. The device comprises a box-shaped suction-channel equipment (1) extending substantially over the entire length and width of the conveyor, blower means (2) for maintaining a negative pressure in the suction-channel system, endless belts (3) performing the transfer of the sheets and running substantially horizontally above the stacks of sheets, the said belts being arranged so that during their transfer movement they run against the outside of the bottom face of the suction-channel system, being subject to the effect of the negative pressure in the suction-channel system, and that during their return movement they run in the suction-channel system. According to the invention, at the transfer side of the conveyor belts (3), in immediate proximity of the running zone of the belts, above each stack of sheets, at least one suction box (5) is provided whose bottom face can be lowered onto the stack of sheets and, correspondingly, whose bottom face can be raised at least to the level of the transfer side of the conveyor belt (3), the said suction box being connected to the suction-channel equipment (1) so as to produce a suction effect at the bottom face of the suction box.

5 Claims, 3 Drawing Figures

SUCTION-LIFTING CONVEYOR FOR TRANSFER FOR SHEET-SHAPED OBJECTS

BACKGROUND OF THE INVENTION

The invention is concerned with a suction lifting conveyor for the transfer of sheet-shaped objects, in particular sheets of plywood veneer, from a stack of sheets or from stacks of sheets placed side by side to further processing or to a new stack.

As is known in prior art, for the said purpose have been used suction-lifting boxes provided with suction pads and moving in the direction of the conveyor as well as up and down or, as an alternative, suction-lifting conveyors provided with an endless conveyor belt or with several conveyor belts jointly operative with an oblong suction-channel box. The conveyor belts run outside the bottom face of the suction-channel box, being subject to the effect of the negative pressure in the system of suction channels, and, having been lowered onto the sheet, the belts produce an adhesive effect on the sheet by the effect of the negative pressure acting through the belt or immediately aside the belt. The sheets pass along with the belts following the bottom face of the suction-channel box until, at the desired location, they are pressed apart from the suction effect of the belts.

SUMMARY OF THE INVENTION

In the conveyors based on a suction-channel box and conveyor belts, the entire suction-channel box is lowered onto the stack of sheets in order to grasp the topmost sheet in the stack. This arrangement is, however, not possible when there are several stacks within the range of the conveyor, because, at some stage, an adjoining stack is likely to interfere with the picking up of a sheet to be taken out of a certain stack. A solution suggested for this problem is the use of separate suction-pad lifting means by which the sheets are picked up onto the conveyor belts running on the bottom face of a stationary suction-channel box. As compared with the former solution described above, this latter solution, however, involves the drawback that the separate suction-pad lifting means require a vacuum system of their own.

Elimination of the drawbacks related to the prior-art suction-lifting conveyors mentioned above has been achieved by means of the suction-lifting conveyor in accordance with the invention, which is mainly based on the above belt-type conveyor provided with a suction-channel box. According to the invention, this construction has been improved so that at the transfer side of the conveyor belt or belts, in immediate proximity of the running zone of the belts, above each stack of sheets, at least one suction box is provided whose bottom face can be lowered down onto the stack of sheets and, correspondingly, whose bottom face can be raised at least up to the level of the transfer side of the conveyor belt, the said suction box being connected with the suction-channel equipment of the conveyor so as to produce a suction effect at the bottom face of the suction box.

BRIEF DESCRIPTION OF THE DRAWINGS

The invention will be described with the aid of the accompanying drawing, wherein.

DETAILED DESCRIPTION

Figure 1:
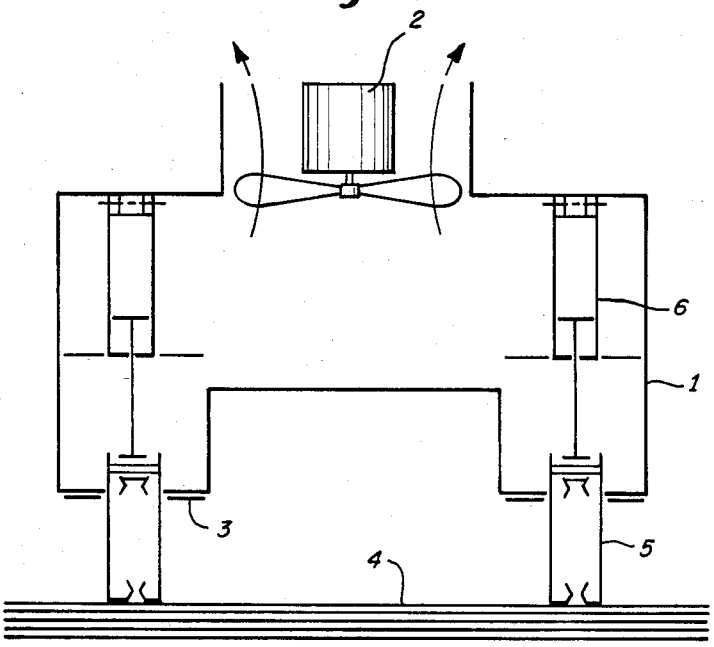
FIG. 1 is a cross-sectional view of a conveyor equipment in accordance with the invention with the suction boxes lowered onto the veneer.
Figure 2:
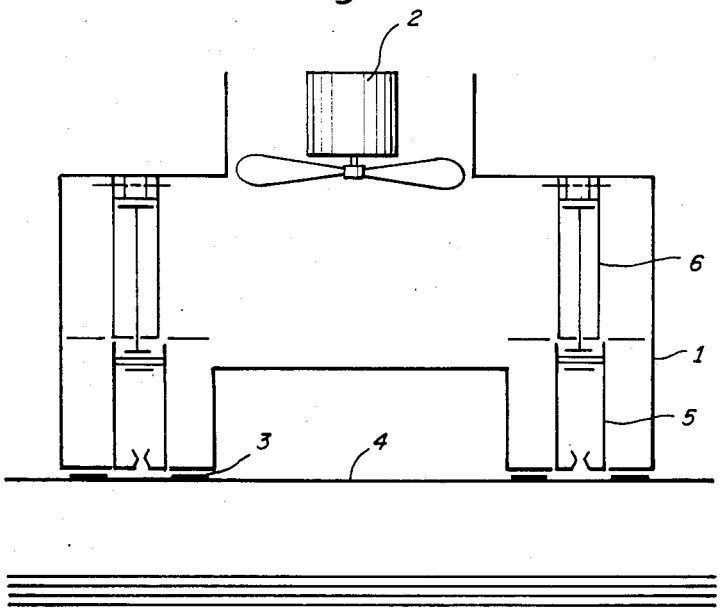
FIG. 2 shows the equipment in accordance with the invention as a cross-section in the transfer position.
Figure 3:
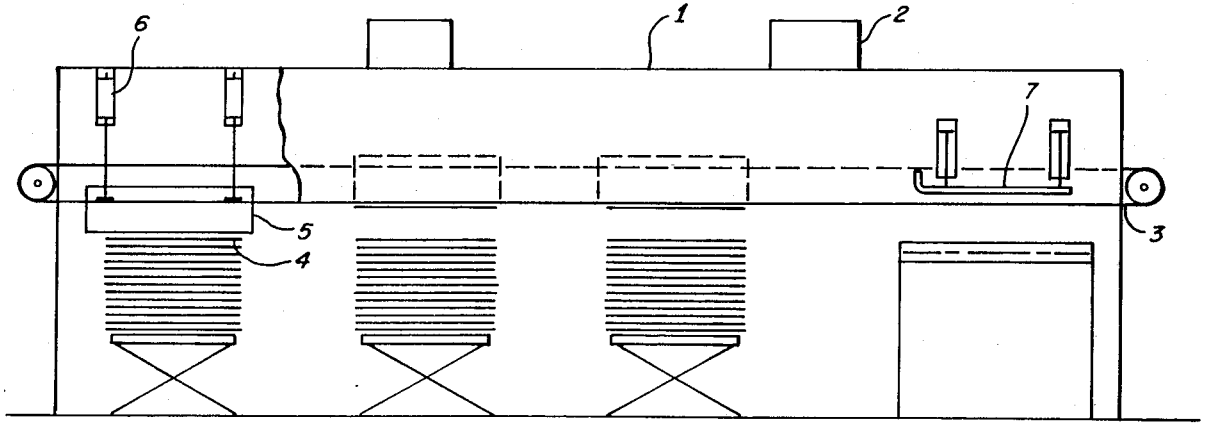
FIG. 3 is a longitudinal sectional side view of the conveyor equipment in accordance with the invention.

The suction-lifting conveyor in accordance with the invention consists of a box-shaped suction-channel equipment 1 extending substantially over the entire length and width of the conveyor, of blower means 2 for maintaining a negative pressure in the suction-channel system, of endless belts 3 performing the transfer of the sheets and running substantially horizontally above the stacks of sheets, the said belts being arranged so that during their transfer movement they run against the outside of the bottom face of the suction-channel system, being subject to the effect of the negative pressure in the suction-channel system, and that during their return movement they run in the suction-channel system. In the embodiment shown, the conveyor belts 3 consist of two pairs of belts placed side by side, each pair being arranged so as to run at the longitudinal edge zones of the suction channel box 1, immediately at both sides of the suction slots of the suction channel box.

In this equipment, for the purpose of lifting the sheets 4 into contact with the belts 3, above each stack of sheets, two suction-box structures 5 are provided, which are placed between the belts in each pair of conveyor belts 3 so that the suction boxes can be lowered down from between the belts so as to reach contact with the top face of the topmost veneer 4 in the stack. The top face and the bottom face of the suction boxes are provided with flow openings or flow slots, whereby the bottom face of the suction boxes is also subjected to the effect of the negative pressure prevailing inside the suction-channel box 1.

By means of the said arrangement it has been achieved that the sheet 4 adheres to the bottom face of the lowered suction box 5 and can be raised along with the suction boxes up against the conveyor belts, which said belts carry the sheet forwards, first supported by the suction of the suction boxes and, when moving forwards, supported by the suction applied to the sheet between the pair of belts from the flow openings in the bottom face of the suction-channel box 1. In the construction concerned, the suction-channel box 1 may be stationary, because it does not have to be displaced vertically as the suction boxes 5 take care of the picking up of the sheets from each stack. Nor do the suction boxes require a separate suction equipment, but they operate by making use of the negative pressure prevailing in the suction channel box. It can be considered that, in their raised position, the suction boxes form parts of the transfer path of the bottom face of the suction-channel box, which path is cut off by them only in the lowered position when picking up a sheet from the stack. By means of the equipment, a sheet can be picked up selectively from different stacks without interfering with the operation of the conveyors of the other stacks.

What is claimed is:

1. Suction-lifting conveyor for the transfer of sheet-shaped objects, in particular of sheets of plywood veneer, one by one from a stack to further processing or to another stack, which said device comprises a box-shaped suction-channel equipment extending substantially over the entire length and width of the conveyor, blower means for maintaining a negative pressure in the suction-channel equipment, at least one endless belt performing the transfer of the sheets and running substantially horizontally above the stack or stacks of sheets, the said at least one belt being arranged so that during the transfer movement it runs against the outside of the bottom face of the suction-channel system, being subject to the effect of the negative pressure in the suction-channel equipment, and that during their return movement they run in the suction-channel system, wherein at the transfer side of the conveyor belt, in immediate proximity of the running zone of the belt, above each stack of sheets, at least one suction box is provided whose bottom face can be lowered onto the stack of sheets and, correspondingly, whose bottom face can be raised at least to the level of the transfer side of the conveyor belt, said suction-channel equipment being substantially closed to effect said negative pressure maintenance but having means at said bottom face for slidably receiving said suction box while maintaining a suction effect in said suction box, and means defining at least one suction flow slot in said bottom face adjacent said suction box and extending in the direction of travel of said at least one belt, the said suction box being connected to the suction-channel equipment so as to produce said suction effect at the suction flow slot at the bottom face of the suction box.

2. Suction-lifting conveyor as claimed in claim 1, including a pair of suction boxes each comprising a box member whose top and bottom sides are provided with flow slots and which can be displaced up and down, being guided by the bottom face of the suction-channel equipment as substantially sealed.

3. Suction-lifting conveyor as claimed in claim 1 or 2, wherein each conveyor belt comprises two parallel belts and that the suction box is arranged in such a way that it can be lowered and raised between these belts.

4. Suction-lifting conveyor as claimed in claim 1, including means for raising the suction box to raise the sheet up against the conveyor belt, which said belt carries the sheet forward, first supported by the suction of the suction box and, when moving forward supported by the suction applied to the sheet from said flow slot.

5. Suction-lifting conveyor as claimed in claim 4, wherein the suction box is disposed below the suction-channel equipment bottom face when selecting a sheet and is disposed with its bottom surface substantially planar with said bottom face when transferring to the conveyor belt.

* * * * *